US010168109B2

(12) United States Patent
Riondet

(10) Patent No.: US 10,168,109 B2
(45) Date of Patent: Jan. 1, 2019

(54) HEADER PLATE FOR A HEAT EXCHANGER, HEADER BOX AND HEAT EXCHANGER

(71) Applicant: Valeo Systemes Thermiques, Le Mesnil Saint Denis (FR)

(72) Inventor: Christian Riondet, Bourgogne (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 0 days.

(21) Appl. No.: 15/513,741

(22) PCT Filed: Sep. 23, 2015

(86) PCT No.: PCT/EP2015/071921

§ 371 (c)(1),
(2) Date: Mar. 23, 2017

(87) PCT Pub. No.: WO2016/046290

PCT Pub. Date: Mar. 31, 2016

(65) Prior Publication Data

US 2017/0299283 A1 Oct. 19, 2017

(30) Foreign Application Priority Data

Sep. 24, 2014 (FR) ..... 14 59041

(51) Int. Cl.
*F28F 9/02* (2006.01)
*F28D 1/053* (2006.01)
*F28D 21/00* (2006.01)

(52) U.S. Cl.
CPC ..... *F28F 9/0229* (2013.01); *F28D 1/0535* (2013.01); *F28F 9/0224* (2013.01); (Continued)

(58) Field of Classification Search
CPC ..... F28D 1/0391; F28D 1/0535; F28D 2021/0082; F28D 2021/0084; F28D 2021/0094; F28F 9/0226
(Continued)

(56) References Cited

U.S. PATENT DOCUMENTS

2001/0054496 A1 12/2001 Kajikawa et al.
2007/0131392 A1* 6/2007 Minami ..... F28D 1/0391 165/110

FOREIGN PATENT DOCUMENTS

DE 10 2006 057851 A1 6/2008
JP H05-18690 A 1/1993
(Continued)

OTHER PUBLICATIONS

International Search Report issued in PCT/EP2015/071921 dated Nov. 3, 2015 (2 pages).
(Continued)

*Primary Examiner* — Davis Hwu
(74) *Attorney, Agent, or Firm* — Osha Liang LLP

(57) ABSTRACT

Header plate for a heat exchanger, comprising a wall (3) provided with orifices (7), and through which tubes (1) arranged in rows in a longitudinal direction (L) are intended to pass, characterized in that:

said wall has (3), in cross section, a profile made up of a central portion (13) and of two lateral portions (15), the lateral portions (15) overall follow a first curve with a first radius of curvature (R1), the central portion (13) overall follows a second curve with a second radius of curvature (R2), smaller than the first radius of curvature (R1).

11 Claims, 2 Drawing Sheets

(52) U.S. Cl.
CPC .... *F28F 9/0226* (2013.01); *F28D 2021/0082* (2013.01); *F28D 2021/0084* (2013.01); *F28D 2021/0094* (2013.01); *F28F 2225/08* (2013.01); *F28F 2265/26* (2013.01)

(58) Field of Classification Search
USPC ..... 165/173
See application file for complete search history.

(56) References Cited

FOREIGN PATENT DOCUMENTS

| | | | |
|---|---|---|---|
| JP | H10-232097 | A | 9/1998 |
| JP | 2005-308366 | A | 11/2005 |

OTHER PUBLICATIONS

Written Opinion of the International Searching Authority issued in PCT/EP2015/071921 dated Nov. 3, 2015 (5 pages).

* cited by examiner

HEADER PLATE FOR A HEAT EXCHANGER, HEADER BOX AND HEAT EXCHANGER

The present invention relates to a header plate (also known as a header) of a motor vehicle heat exchanger, for example for a radiator for cooling the engine, for an air conditioning condenser, for a charge air cooler, and to a header tank and to a heat exchanger.

A header plate for a heat exchanger, comprising a wall provided with orifices, and through which tubes arranged in rows in a longitudinal direction are intended to pass, is already known, from document JP2005/308366. This plate has a central portion for accepting the tubes which is curved inward or outward.

It is known that the curvature of the header plates is aimed at avoiding as far as possible deterioration of the heat exchanger caused by local temperature differences that place a great deal of stress on the tube and load the join between the header plate and the tubes, notably on the external radii of the tube. This join may be embodied by a joint or by brazing or alternatively by direct welding between the tube and the plate. Ultimately, the join may end up no longer being sealed, thereby placing the exchanger out of action. A high pressure at which the fluid circulates inside the exchanger is of course a factor that aggravates this phenomenon.

Of the numerous solutions already proposed none has hitherto made it possible to completely eliminate this problem of deterioration of the join between header plate and tube.

It is an object of the invention to provide a solution that overcomes these disadvantages, notably by reducing the stresses applied to the tube.

A first subject of the invention is a header plate for a heat exchanger, comprising a wall provided with orifices, and through which tubes arranged in rows in a longitudinal direction are intended to pass, characterized in that:

said wall has, in cross section, a profile made up of a central portion and of two lateral portions, the lateral portions overall follow a first curve with a first radius of curvature, the central portion overall follows a second curve with a second radius of curvature, smaller than the first radius of curvature.

For preference, what is meant by "smaller than" is representing under 80% of the reference value. Thus, for preference, the second radius of curvature needs to be less than 80% of the first radius of curvature.

According to a first embodiment, at least one of the orifices has, in a direction perpendicular to the longitudinal and transverse directions, an oblong projection of major axis TW (also referred to as the "width of the tube passage orifice in the header"), and, with respect to a plane passing through longitudinal edges of the wall, the height of the lateral portions is H1 and the height of the central portion is H2, and the ratio between the heights H1, H2 and the major axis TW satisfies the following inequalities:

$$0.05<H1/TW<0.2$$

$$0.05<H2/TW<0.3.$$

By satisfying these recommendations a heat exchanger is obtained in which the stress applied to the tube is reduced as much as possible.

For preference, the major axis (TW) of a tube (or the tube passage width) is comprised between 10 mm and 100 mm.

In one particular embodiment, at least one of the orifices comprises a collar intended to cover part of the wall of the tube passing through the wall via this orifice, this collar projecting toward the outside of the header. Such a collar has the purpose of improving the sealing between the tube and the header plate.

In one particular alternative form of this embodiment, the collar comprises a groove to accommodate a gasket interposed between said collar and the tube.

For preference, the orifices are spaced apart by a spacing comprised between 5 mm and 10 mm, preferably comprised between 6 mm and 8 mm.

In one particular embodiment, the header plate is formed in a metal sheet with a thickness comprised between 0.7 mm and 2 mm, preferably between 1 mm and 1.5 mm.

Another subject of the invention is a header tank comprising a header plate as described hereinabove and a cover made of plastic or of metal, connected to the header plate by crimping, bonding, brazing or welding.

Another subject of the invention is a heat exchanger comprising such a header tank and tubes.

For preference, the tubes are formed in a metal sheet with a thickness comprised between 0.1 mm and 0.5 mm, preferably between 0.2 mm and 0.3 mm.

For preference, the tubes are obtained by electric arc welding, bending into several canals, or clipping.

The invention will be better understood from studying the attached figures which are given by way of example and are not in any way limiting.

Figure 1:
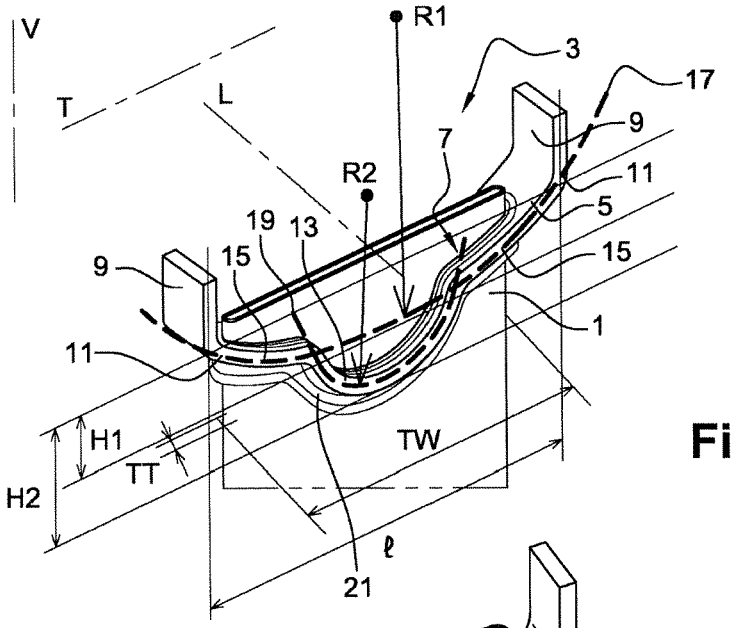
FIG. 1 is a view in perspective and partial cross section of a header plate and of a tube according to a first embodiment of the invention.

Reference is now made to FIG. 1 which shows the upper part of a tube 1 of oblong section. The tube 1 is shown here in a vertical orientation. The reference to its upper end is relative to the vertical direction V in the figure.

The oblong section of the tube has the following dimensions:

major axis TW=34 mm (between 10 and 100 mm)

minor axis TT=1.4 mm (between 1 and 4 mm, preferably between 1 and 2 mm).

The tube is formed from a metal sheet of thickness 0.3 mm, by electric arc welding, bending or clipping.

A header plate 3, referred to hereinafter as a plate, has the tube 1 passing through it.

Because of the partial section shown in the figure, only a section of this plate 3 is visible. This same section repeats in the longitudinal direction L of the plate, as many times as the plate has tubes, which tubes are arranged in rows parallel to one another in this same longitudinal direction L. The spacing between two adjacent tubes is comprised between 5 and 10 mm, preferably between 6 and 8 mm.

The direction T which is perpendicular to the direction L is defined as generally being in the plane in which the plate extends. The direction T is the direction in which the major lengths of the tube ends extend.

The plate 3 is formed from an aluminum sheet of a thickness comprised between 0.7 and 2 mm, preferably between 1 and 1.5 mm, by stamping.

The plate 3 comprises a wall 5 equipped with orifices (of which just one, 7, is visible in the figure, as explained previously), bordered by two longitudinal turnups 9 which are used to connect the header plate 5 to a cover (not depicted). As is known, the cover encloses the volume situated above the header plate 5 to form a header tank. The connection between the header plate 5 and the cover is made by any suitable means, notably depending on the material of which the cover is made. For example, if the cover is made of a plastics material, the connection may be made by crimping or by bonding. Likewise, if the cover is made of metal, the connection may be made by crimping, bonding, brazing or welding. A gasket (not depicted) may, although this is not compulsory, be interposed between the exterior wall of the tube, a cover (not depicted), the turnup 9 and the header plate.

Between the longitudinal turnups 9 and the wall 5 equipped with orifices, the header plate is bent to form two edges or radii 11.

The wall 5 provided with orifices has, in cross section, a profile made up of a central portion 13 and of two lateral portions 15. The lateral portions 15 overall follow a curve 17 of a first radius of curvature R1. The central portion overall follows a curve 19 with a second radius of curvature R2, smaller than the first radius of curvature R1. The two, central 13 and lateral 15, portions form a bump toward the outside of the exchanger, and therefore downward in the figure.

The radii of curvature R1 and R2 may be defined by measuring the heights of the curves with respect to the plane defined by the two edges 11:

The height of the lateral portions 15 is denoted H1 and the height of the central portion 13 is denoted H2. The radii R1 and R2 are the geometric result of these values H1, H2 and of the width I of the plate in the transverse direction.

For preference, in order to optimize the reduction of stress at the joint between the tube 1 and the plate 3 as a result of thermal expansions, the ratio between the heights H1, H2 and the major axis TW satisfies the following inequalities:

$$0.05<H1/TW<0.2$$

$$0.05<H2/TW<0.3.$$

Here, given that H1=2 mm, H2=4 mm, TW=34 mm, the inequalities are satisfied because $$H1/TW=0.058$$

$$H2/TW=0.12.$$

The orifice 7 has, in the vertical direction V of the drawing, which is a direction perpendicular to the longitudinal L and transverse T directions of the plate, an oblong projection of major axis TW, which will also be referred to more simply as width TW.

Furthermore, the orifice 7 has a collar 21 intended to cover part of the wall of the tube 1 passing through the wall 5 via this orifice 7, this collar 21 projecting toward the outside of the header (and therefore downward in the figure). The collar 21 is obtained by stamping, during the forming of the plate 3. To do that, material is upset by a punch during stamping, as with the rest of the plate 3, making the stamping operation easier. One disadvantage with this arrangement is that the tube 1 is not so easy to insert into the orifice 7 when assembling the header, because the end of the collar 21 via which the tube 1 is to be inserted is a little narrower. By contrast, this arrangement is advantageous insofar as it further reduces the stresses applied to the tube 1. It is therefore more favorable to the longevity of the exchanger.

The plate 3 may comprise a groove (not depicted) to accept a gasket (not depicted) interposed between a cover (not depicted) and the plate 3.

Figure 2:
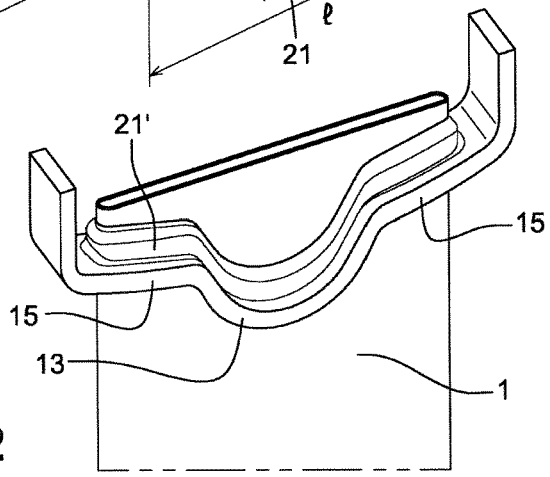
FIG. 2 is a view analogous to that of FIG. 1 according to a second embodiment of the invention.

The embodiment of FIG. 2 differs from the previous one in that the collar 21' projects from the wall toward the inside of the exchanger, namely upward in the figure. The other information provided in relation to FIG. 1 is valid for this FIG. 2.

Figure 3:
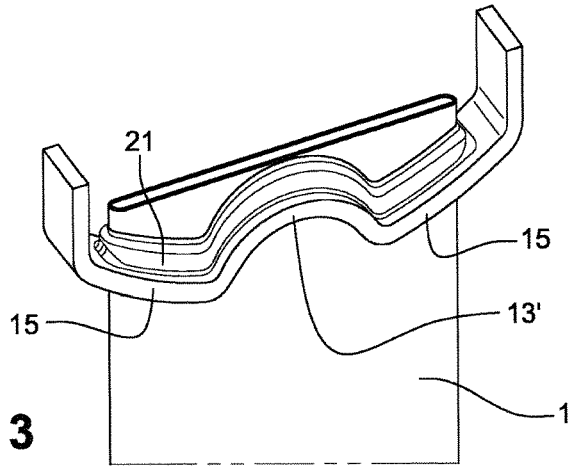
FIG. 3 is a view analogous to that of FIG. 1 according to a third embodiment of the invention.

The embodiment of FIG. 3 differs from the previous one in that the central portion 13' of the profile forms a bump toward the inside of the exchanger, namely upward in the figure. The other information given in relation to FIGS. 1 and 2 is valid for this FIG. 3.

The collar 21' has the advantage of making the exchanger easier to assemble because the tubes are easier to insert into the orifices than in the embodiment of FIG. 1.

This embodiment is also advantageous as far as reducing the stresses applied to the tube 1 is concerned.

Figure 4:
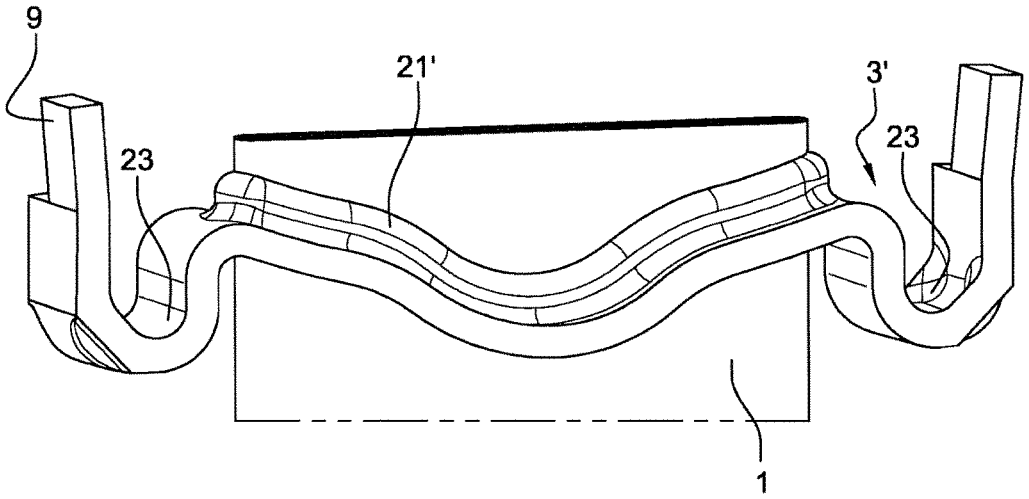
FIG. 4 is a view analogous to that of FIG. 1 according to a fourth embodiment of the invention.

The embodiment of FIG. 4 differs from the previous one in that the header plate 3' comprises a groove 23 in which a gasket (not depicted) can be inserted in order to sealing against a cover (not depicted).

The invention is not restricted to the embodiments presented and other embodiments will be clearly apparent to a person skilled in the art.

The invention claimed is:

1. A header plate for a heat exchanger, comprising:

a wall provided with orifices, and through which tubes arranged in rows in a longitudinal direction are intended to pass, wherein:

said wall has, in cross section, a profile made up of a central portion and of two lateral portions, the two lateral portions overall follow a first curve with a first radius of curvature, the central portion overall follows a second curve with a second radius of curvature, smaller than the first radius of curvature, and at least one of the orifices comprises a collar that covers part of the wall of the tube passing through the wall via the at least one orifice, the collar projecting toward the outside of the header.

2. The header plate as claimed in claim 1, in which at least one of the orifices has, in a direction perpendicular to the longitudinal and transverse directions, an oblong projection of major axis TW, and in which, with respect to a plane passing through longitudinal edges of the wall, the height of the lateral portions is H1 and the height of the central portion is H2, and in which the ratio between the heights H1, H2 and the major axis TW satisfies the following inequalities: 0.05<H1/TW<0.2 0.05<H2/TW<0.3.

3. The header plate as claimed in claim 2, in which the major axis TW is comprised between 10 mm and 100 mm.

4. The header plate as claimed in claim 1, in which the orifices are spaced apart by a spacing comprised between 6 mm and 8 mm.

5. The header plate as claimed in claim 1, formed in a metal sheet with a thickness comprised between 1 mm and 1.5 mm.

6. A header tank comprising:

a header plate as claimed in claim 1; and a cover made of plastic or of metal, connected to the header plate by one of: crimping, bonding, brazing and welding.

7. The header tank as claimed in claim 6, comprising a groove to accommodate a gasket interposed between the header plate and the cover.

8. A heat exchanger comprising:

a header tank as claimed in claim 6; and tubes formed in a metal sheet with a thickness comprised between 0.2 mm and 0.3 mm.

9. A heat exchanger comprising:

a header tank as claimed in claim 7; and tubes obtained by one of: electric arc welding, bending into several canals, and clipping.

10. A header plate for a heat exchanger, comprising:

a wall provided with orifices, and through which tubes arranged in rows in a longitudinal direction are intended to pass, wherein:

said wall has, in cross section, a profile made up of a central portion and of two lateral portions, the two lateral portions overall follow a first curve with a first radius of curvature, the central portion overall follows a second curve with a second radius of curvature, smaller than the first radius of curvature, and at least one of the orifices has, in a direction perpendicular to the longitudinal and transverse directions, an oblong projection of major axis TW.

11. The header plate as claimed in claim 10, in which, with respect to a plane passing through longitudinal edges of the wall, the height of the lateral portions is H1 and the height of the central portion is H2, and in which the ratio between the heights H1, H2 and the major axis TW satisfies the following inequalities: $0.05<H1/TW<0.2$ $0.05<H2/TW<0.3$.

* * * * *